US010982636B2

(12) United States Patent
Renner et al.

(10) Patent No.: US 10,982,636 B2
(45) Date of Patent: Apr. 20, 2021

(54) INTERNALLY PRESSURIZED COMPONENT (RAIL) AND METHOD FOR PRODUCING SAME

(71) Applicant: Hirschvogel Umformtechnik GmbH, Denklingen (DE)

(72) Inventors: Florian Renner, Bad Kohlgrub (DE); Thomas Sellmann, Irsee (DE); Florian Geiger, Böbing (DE)

(73) Assignee: Hirschvogel Umformtechnik GmbH, Denklingen (DE)

( * ) Notice: Subject to any disclaimer, the term of this patent is extended or adjusted under 35 U.S.C. 154(b) by 130 days.

(21) Appl. No.: 16/082,732

(22) PCT Filed: Mar. 3, 2017

(86) PCT No.: PCT/EP2017/055421

§ 371 (c)(1),
(2) Date: Sep. 6, 2018

(87) PCT Pub. No.: WO2017/153460

PCT Pub. Date: Sep. 14, 2017

(65) Prior Publication Data

US 2019/0093614 A1 Mar. 28, 2019

(30) Foreign Application Priority Data

Mar. 11, 2016 (DE) ..... 10 2016 204 025.1

(51) Int. Cl.
*F02M 55/00* (2006.01)
*F02M 55/02* (2006.01)
*F02M 61/16* (2006.01)

(52) U.S. Cl.
CPC ..... *F02M 55/025* (2013.01); *F02M 61/168* (2013.01); *F02M 2200/8069* (2013.01);
(Continued)

(58) Field of Classification Search
CPC ..... F02M 55/025; F02M 61/168; F02M 2200/857; F02M 2200/855; F02M 2200/8084; F02M 2200/8069
See application file for complete search history.

(56) References Cited

U.S. PATENT DOCUMENTS 5,735,247 A * 4/1998 Tsuzuki ..... F02M 51/005 123/456
6,148,797 A * 11/2000 Gmelin ..... F02M 61/14 123/456

(Continued)

FOREIGN PATENT DOCUMENTS

DE 202014104466 U1 9/2014
DE 102014108163 A1 12/2015
EP 2998566 A1 * 3/2016 ..... F02M 61/14

OTHER PUBLICATIONS

International Search Report issued in connection with the corresponding International Application No. PCT/EP2017/055421 dated Jun. 8, 2017.

(Continued)

*Primary Examiner* — Phutthiwat Wongwian
*Assistant Examiner* — Sherman D Manley
(74) *Attorney, Agent, or Firm* — The H.T. Than Law Group

(57) ABSTRACT

The present invention relates to a method for producing an internally pressurized component (1), having the steps of: providing a main body (2) with a longitudinal cavity (3) and with an attachment flange (6) for attachment of the internally pressurized component (1), providing a (80), introducing a through-bore (7) that extends longitudinally through the attachment flange (6) and has two opposite openings (70, 71) with respect to the longitudinal axis (L7), inserting the pin (80) into the through-bore (7) such that the pin (80) is arranged flush with the attachment flange (6) on the side of (Continued)

one of the openings (70) and extends from this opening (70) through the through-bore (7) and through the other opening (71) in order to project from the attachment flange (6), materially bonding the pin (80) to the attachment flange (6), and introducing a longitudinal bore (81) into the pin (80) to form an attachment sleeve (8). The invention also relates to a corresponding internally pressurized component (1).

28 Claims, 7 Drawing Sheets

(52) U.S. Cl.
CPC ..... *F02M 2200/8084* (2013.01); *F02M 2200/855* (2013.01); *F02M 2200/857* (2013.01)

(56) References Cited

U.S. PATENT DOCUMENTS 6,640,784 B1 * 11/2003 Sims, Jr. ..... F02M 55/025 123/456
7,412,970 B2 * 8/2008 Apel ..... F02M 61/14 123/470
7,765,984 B2 * 8/2010 Fuerst ..... F02M 61/14 123/456
2008/0075403 A1 * 3/2008 Holt ..... F02M 55/025 384/551
2011/0265766 A1 * 11/2011 Niwa ..... F02M 55/025 123/468
2012/0138020 A1 * 6/2012 Kweon ..... F02M 55/025 123/469
2012/0298064 A1 11/2012 Brand et al.
2013/0104852 A1 * 5/2013 Kannan ..... F16F 1/41 123/456
2013/0340714 A1 * 12/2013 Serra ..... F02M 55/025 123/456
2015/0075495 A1 * 3/2015 Fischer ..... F02M 55/005 123/456
2015/0075496 A1 * 3/2015 Pasquali ..... F16B 41/002 123/469
2015/0176672 A1 6/2015 Rehwald et al.
2016/0222935 A1 * 8/2016 Lang ..... F02M 69/465
2016/0305387 A1 * 10/2016 Haug ..... F02M 69/462
2017/0130686 A1 * 5/2017 Schultz ..... F02M 55/025
2018/0003203 A1 * 1/2018 Kochanski ..... F16B 43/00
2018/0128223 A1 * 5/2018 Park ..... F02M 55/005
2018/0230954 A1 * 8/2018 Oh ..... F02M 55/025

OTHER PUBLICATIONS

Machine translation of DE 202014104466 to Benteler Automobiltechnik GmbH.
Machine translation of DE 102014108163 to Schultz.

* cited by examiner

INTERNALLY PRESSURIZED COMPONENT (RAIL) AND METHOD FOR PRODUCING SAME

FIELD OF THE INVENTION

The present invention relates to an internally pressurized component, especially in the formation of a high-pressure fuel storage (rail) for example for a common-rail fuel injection system of an internal combustion engine, as well as a method for production of such a component.

Corresponding internally pressurized components, especially high-pressure fuel storages, are known from the prior art. These generally comprise a main body with a longitudinal cavity or an elongated blind borehole. The main body preferably has, moreover, at least one connection flange, likewise with an elongated borehole, which connects the longitudinal cavity to the outside. A rail is part of a fuel injection system and serves for the distributing of the fuel, delivered by means of a fuel pump, to the individual cylinders of an internal combustion engine. Rails are generally made of steel and especially stainless steel.

Such internally pressurized components generally have fastening elements, formed integrally with the component base body, in order to correspondingly fasten the internally pressurized component to an engine block, for example. These fastening elements formed integrally with the base body comprise a through opening, into which a fastening screw is introduced, in order to screw the component together with the engine block. The drawback to this configuration is the heavy weight, due to being produced by forging techniques, especially for the fastening elements, as these require correspondingly large wall thicknesses and transitional regions due to their integrated formation with the base body. This, in turn, results in a high material input and consequently relatively high costs.

Thus, one problem which the present invention proposes to solve is to provide an internally pressurized component and a method for its production which enable an easy production with a weight-optimized design of the component.

This problem is solved by the subject matter of the independent claims. The dependent claims develop the central idea of the invention especially advantageously.

SUMMARY OF THE INVENTION

According to a first aspect, the present invention relates to a method for the production of an internally pressurized component, especially in the formation of a high-pressure fuel storage (rail). This method comprises the following steps:

- providing a main body with a longitudinal cavity and with an attachment flange for attachment of the internally pressurized component,
- providing a pin,
- introducing a through borehole that extends longitudinally through the attachment flange and having two opposite openings with respect to the longitudinal axis,
- inserting the pin into the through borehole such that the pin is arranged flush with the attachment flange on the side of one of the openings and extends from this opening through the through borehole and through the other opening in order to project from the attachment flange,
- materially bonding the pin inserted into the through borehole to the attachment flange, and

- introducing a longitudinal borehole into the pin to form an attachment sleeve.

By means of this method, an easy option is provided for the production of an internally pressurized component with weight-optimized configuration. The use of a pin which is inserted into a correspondingly provided borehole and which is arranged therein materially bonded (e.g., welded) to the attachment flange forms a secure and easy attachment for a corresponding attachment element. The introducing of the longitudinal borehole into the pin may occur essentially at any given moment of time; i.e., when providing the pin, before or after the inserting of the pin into the through borehole, and also before or after the material bonding of the pin to the attachment flange. It is also conceivable to introduce the longitudinal borehole in several steps which are performed in direct succession or separated by other steps of the method. Thus, the longitudinal borehole can be introduced into the pin during the providing of the pin, for example, and be reworked after the material bonding in a finishing or precision machining step. Hence, the attachment sleeve may be configured optimally in terms of geometry and material. For example, it may also be formed from a material different from the main body, in order to be designed optimally for the set requirements.

The pin or the attachment sleeve may be inserted substantially loosely—e.g., preferably with a clearance fit—into the through borehole. A transition fit is also conceivable. In particular, the inserting should be as simple as possible and at the same time securely—also in regard to an automated production. The through borehole may preferably be introduced such that it widens at least partly (e.g., conically) from the one opening to the other opening in order to form an inserting slope for the attachment sleeve or the pin. The end of the attachment sleeve or the pin being introduced or introduced may have a shape corresponding to the through borehole and especially to the widened region (e.g., likewise conical). The above provision can facilitate the introducing, especially during an automated production. The introduced pin or the introduced attachment sleeve may also lie all around against the inner wall of the through borehole, at least in the region of the one opening. In this way, it can be ensured that the pin or the attachment sleeve after the inserting and before the material bonding is held sufficiently firmly in the longitudinal borehole until a materially bonded connection which is sufficiently secure and strong enough for the operation of the component has been produced. This facilitates the handling of the component during the production.

The materially bonded connection may be provided all around at least in the region of the one opening and preferably closing the one opening.

The step of the material bonding can be done here by means of welding and especially laser welding. As the pin is preferably welded by laser only from above, a rapid and easy connection of the attachment sleeve or the pin to the main body or the attachment flange is made possible, while at the same time a secure connection is provided.

After the material bonding, regions of such a resultant weld seam projecting from the attachment flange can be removed and in particular milled away or ground away. Such a machining—for example overmilling—of a weld seam serves especially for prevention of corrosion and also ensures a level surface, serving for example for the abutment of a screw head of an attachment screw for the mounting of the internally pressurized component.

At least one connection flange can be provided on the main body with a through opening which is open to the outside and emerges into the longitudinal cavity. Here the main body may preferably be formed integrally with the attachment flange and/or the connection flange and preferably be produced by forging. Generally speaking, preferred main bodies with attachment flange and optionally also connection flange are formed integrally with each other. Basically, it is also conceivable for the attachment flange and/or connection flange to be materially bonded to the main body, this embodiment being less preferred that the integral formation by forging, for example.

In the context of the invention, a material bonding—i.e., the connecting of several parts by means of material production techniques such as for example welding, soldering, or the like—is to be distinguished from an integral design/formation in which different subregions of a component are produced as a single piece in a single production process—such as for example forging or casting.

The through borehole and/or the longitudinal borehole and/or the longitudinal cavity and/or the through opening are introduced preferably by means of cutting production methods, such as in particular drilling, milling, reaming and/or honing. The production process can be further optimized by using in particular the same cutting production methods.

The attachment sleeve is preferably milled flat at its end opposite the attachment flange. In this way, the attachment sleeve can be cut to a desired length. Furthermore, the side facing the installation region of the internally pressurized component—i.e., the side with which the attachment sleeves are placed on the engine block, for example—can be adapted to the geometrical shape or orientation of the installation region. Basically, it is also conceivable for the pin to be cut correspondingly to length and preferably milled flat even before the introducing of the longitudinal borehole.

The above indicated method can basically be at least partly automated or performed partly automatically, which further boosts the effectiveness of the method.

According to another aspect, the present invention moreover relates to an internally pressurized component itself, which is made according to a method of the present invention.

According to another aspect, the present invention relates to an internally pressurized component, especially in the formation of a high-pressure fuel storage (rail), comprising a main body with a longitudinal cavity, an attachment flange for attachment of the internally pressurized component, the attachment flange having a through borehole that extends longitudinally through the attachment flange and having two opposite openings with respect to the longitudinal axis, and an attachment sleeve (i.e., including longitudinal borehole such as for example pin with longitudinal borehole) inserted into the through borehole, wherein the attachment sleeve is arranged flush with the attachment flange on the side of one of the openings and extends from this opening through the through borehole and through the other opening in order to project from the attachment flange. The attachment sleeve is materially bonded to the attachment flange.

By contrast with an integral formation of the attachment element with the main body, the present invention is characterized by the material bonding of two components—main body with attachment flange on the one hand and attachment sleeve/pin on the other hand—especially by a lower weight, which is of great importance especially in the automotive industry. Furthermore, a sufficiently sturdy and long-lasting connection can be provided by a material bonding, which also stands up to the forces occurring during operation. Furthermore, owing to the flush orienting of the attachment sleeve in relation to the attachment flange, the most level as possible surface can also preferably be provided for the abutment of a screw head of an attachment screw, for example. The attachment flange here may preferably have a bearing surface for just such a flange region, especially a screw head, of an attachment element extending through the attachment sleeve, especially an attachment screw, on the side of the one opening for the mounting of the internally pressurized component. Since the attachment sleeve is merely inserted into the through borehole, an easy introducing can furthermore be made possible, for example for an automated feeding of attachment sleeve/pin; especially as compared to a clamping by providing an oversized dimension.

In one preferred embodiment, the internally pressurized component is made of steel and in particular stainless steel, which can withstand the pressures needed for the fuel feeding for example in the configuration of a rail. The attachment sleeve or the pin here may also be made of another material which is suited in particular to the demands of the attachment function.

The attachment sleeve may be materially bonded all around to the attachment flange at least in the region of the one opening and preferably closing the one opening. In this way, a secure connection is provided between attachment sleeve and attachment flange. Since the corresponding material bonding only needs to be provided on one side, the internally pressurized component is furthermore easy to produce.

The materially bonded connection can be produced by welding, especially laser welding. A materially bonded connection correspondingly formed is especially advantageous for the preferred materials—such as stainless steel—for the producing of a secure connection.

The materially bonded connection and especially a weld seam formed by welding can preferably be formed overlapping the attachment flange and the attachment sleeve. In this way, a firm materially bonded connection is made possible.

The materially bonded connection and especially a weld seam formed by welding can have a depth for example of 2 to 10 mm, preferably 3 to 7 mm and especially preferably 3.5 to 6 mm. Since deeper welding spots are permissible on the surface, especially in the region of the weld seam, an especially secure materially bonded connection can be provided in this way. Of course, the depth of the weld seam is basically dependent on the materials and dimensions of the components being joined, so that the invention is not limited to this.

The attachment sleeve is inserted substantially loosely, for example with a clearance fit, or with a transition fit, into the through borehole. Thus, regardless of the additionally provided materially bonded connection, the attachment sleeve—or a corresponding pin with or without longitudinal borehole as in the method described above—can be easily inserted into the through borehole, in order to be finally welded accordingly to the attachment flange. In particular, the through borehole (so designed) makes it possible to easily assemble the attachment sleeve or a corresponding pin even before a materially bonded connection of these components and furthermore hold them sufficiently firmly until a later materially bonded connection, without the attachment sleeve dropping out from the through borehole.

In one preferred embodiment, the through borehole widens at least partly from the one opening to the other opening. In particular, the through borehole may have an at least partly conical shape. In this way, the through borehole may form a kind of inserting slope for the attachment sleeve or the pin. In this way, the assembling of attachment sleeve/pin on the one hand with the attachment flange on the other hand can also be made easier. Since the through borehole tapers toward the one opening, it can moreover be made possible, especially in the preferred region for the materially bonded connection, that the mating pieces come together as close as possible in the region of the butt weld, in order to make possible a firm welded connection during the materially bonded connection of the two components. In this case for example, the attachment sleeve may lie all around against the inner wall of the through borehole, at least in the region of the one opening. This furthermore allows a centering of the attachment sleeve relative to the through borehole and thus a defined positioning and orienting of the attachment sleeve or the pin. The introduced end of the attachment sleeve or the pin may have a shape (such as conical) corresponding to the through borehole—at least in the widening (conical) region of the through borehole.

Preferably, the attachment sleeve, especially its end introduced into the through borehole, on the one hand, and the through borehole on the other hand have the same cross section contour and especially a corresponding shape, so that a firm receiving of the attachment sleeve in the through borehole and moreover a firm materially bonded connection of these two mating pieces is made possible.

Moreover, the internally pressurized component may comprise at least one connection flange with a through opening which is open to the outside and emerges into the longitudinal cavity. This connection flange or the through opening connected to the longitudinal cavity serves ultimately for the distributing of fuel delivered into the longitudinal cavity to the respective cylinders of an internal combustion engine, for example.

The main body and the attachment flange and, if present, the connection flange are preferably formed integrally with each other. In particular, these components may be provided forged as an integrally formed component.

Of course, the internally pressurized component may also comprise several attachment sleeves—such as four—each of them being correspondingly inserted in an attachment flange and being materially bonded to it. Each attachment sleeve in this case may be assigned its own attachment flange. However, it is also conceivable for at least some of the attachment flanges to be formed integrally with one another, so that one attachment flange may also receive several attachment sleeves accordingly.

It is furthermore conceivable for at least some of the connection flanges and some of the attachment flanges to be formed integrally with one another.

Moreover, the main body—especially in the embodiment of the component as a rail—may have a sensor connection flange preferably formed integrally integrated with the main body, which serves for providing a pressure sensor (such as a rail pressure sensor).

Further embodiments and advantages of the present invention shall be explained more closely below with the aid of the drawings of the accompanying figures. The same reference numbers are used for the same features. There are shown here:

BRIEF DESCRIPTION OF THE DRAWINGS

FIGS. 1 to 7 show various steps for the production of an internally pressurized component 1 according to the invention. In particular, FIG. 7 shows the finally ready internally pressurized component 1. The component 1 can be designed in the formation of a high-pressure fuel storage (rail), for example for a common-rail fuel injection system of an internal combustion engine (such as a gasoline engine or a diesel engine), especially for direct gasoline injection.

DETAILED DESCRIPTION OF THE PREFERRED EMBODIMENTS

Figure 1:
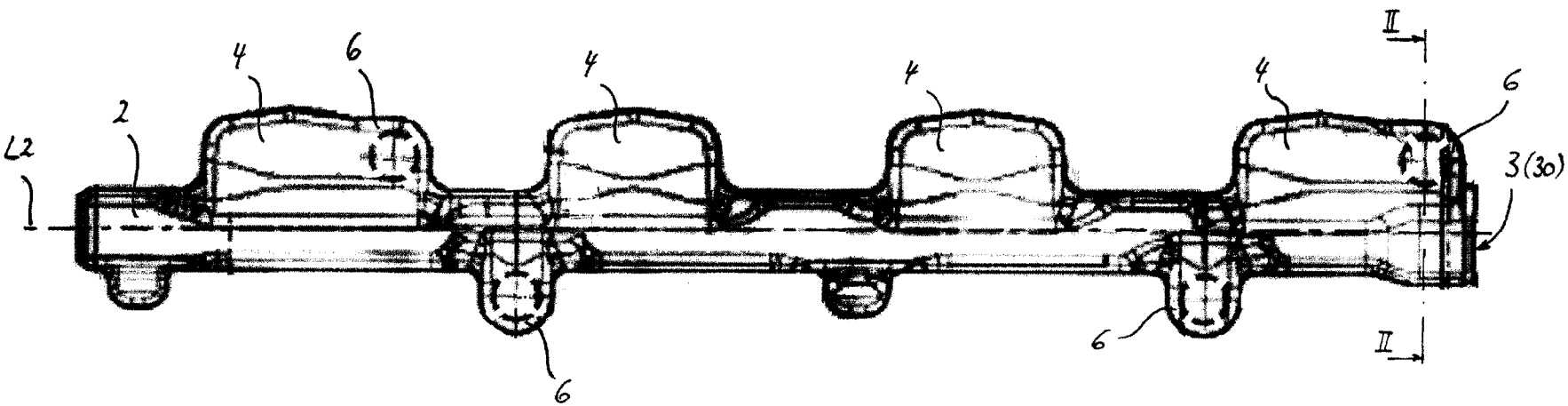
FIG. 1, a bottom view of a main body of an internally pressurized component according to the invention with attachment flanges and connection flanges before introducing through boreholes, shown hatched here for illustrative purposes, FIG. 2, a simplified cross sectional view through the section II-II of FIG. 1 in the region of a through borehole introduced here, FIG. 3, a side view of the main body of FIG. 1 with pins inserted in the through boreholes, FIG. 4, a cross sectional view according to section IV-IV of FIG. 3 after a material bonding of the pin (here, without longitudinal borehole) to the attachment flange, FIG. 5, a detail sectional view (right region of the component of FIGS. 1 and 3) in top view of the component according to the invention with sectioning plane in the region of the flush arrangement of the pin with the attachment flange and machined weld seam, FIG. 6, a side detail sectional view of the internally pressurized component of FIG. 5 after introducing a longitudinal borehole in the pin, and FIG. 7, another side detail sectional view (left region of the component of FIGS. 1 and 3) starting from the internally pressurized component of FIG. 6 with attachment sleeve cut to length.

The internally pressurized component 1 is configured such that a fluid, such as a fuel for example, can flow through it under pressure. The component 1 may be made of metal; for example, aluminum or steel (especially stainless steel) or titanium. However, other materials are also conceivable, so long as these can withstand the pressure exerted on the component 1.

The component 1 comprises a main body 2 with a longitudinal cavity 3. The longitudinal cavity 3 is preferably open at one end, looking in the longitudinal direction. Through the one-ended opening so formed, fuel can be delivered for example by a fuel pump into the longitudinal cavity 3 of the main body 2. By the longitudinal direction is meant the longitudinal extension L2 of the substantially elongated component 1 or main body 2.

In the embodiment represented here, especially for a rail, the main body 2 has at least one connection flange 4. The figures show a total of four connection flanges 4. However, the number is not limited by the invention. The connection flange 4, for example, may be provided for the connecting of a fluid conveying element, such as for example a fuel line. Preferably, the component 1 when used as a rail has at least one connection flange 4 for each cylinder of the corresponding internal combustion engine. Besides the connection flange 4, there may also be provided a sensor connection flange S, as shown for example in FIG. 3. This may serve to provide a pressure sensor (such as a rail pressure sensor).

Figure 7:
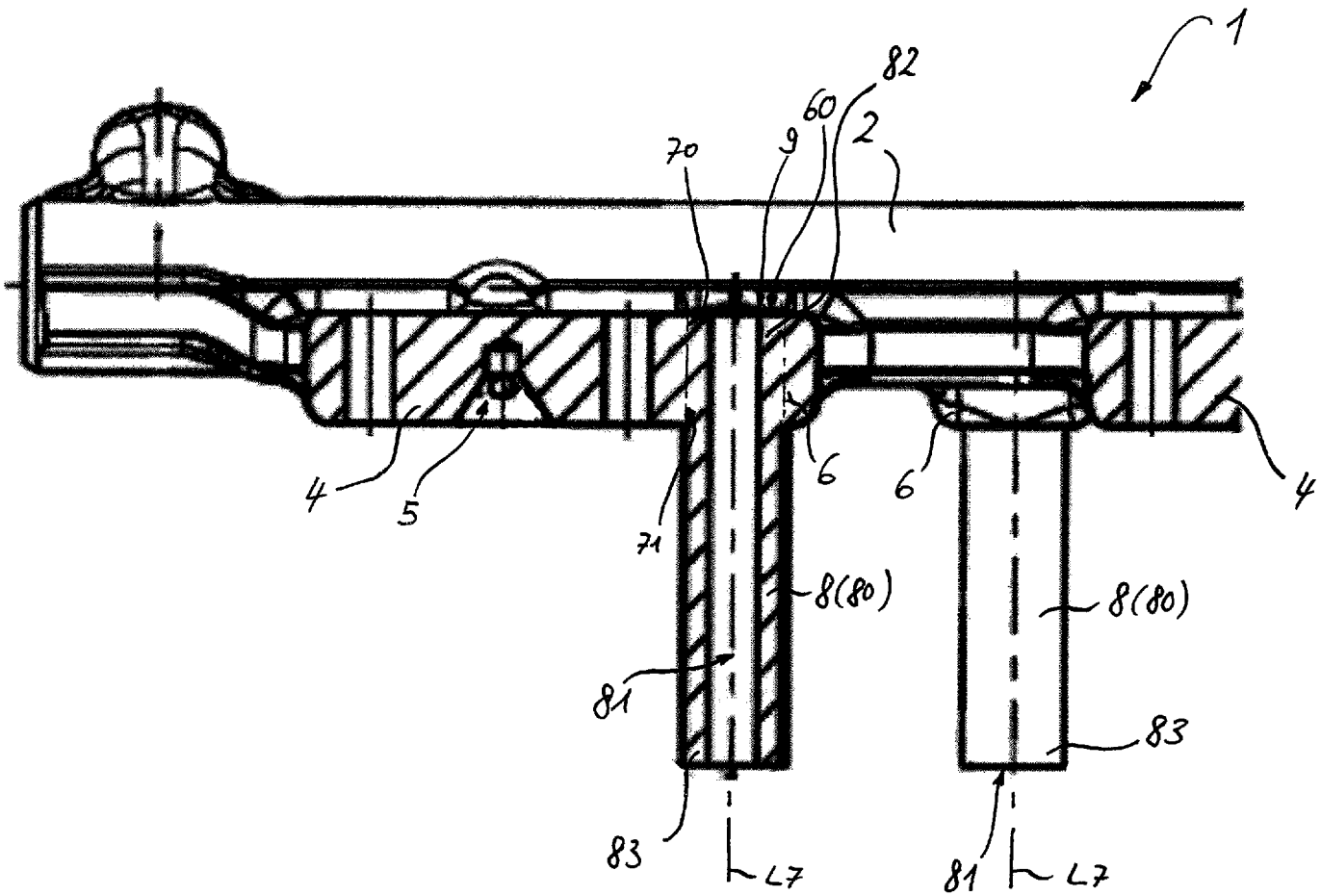

As can be seen particularly in FIG. 7, the connection flange 4 may comprise a through opening open to the outside and emerging into the longitudinal cavity 3. For example, when the component 1 is used as a rail, fuel delivered through the opening 30 into the longitudinal cavity 3 may thus be further distributed across the through openings 5 emerging into the longitudinal cavity 3 among the (at least one, here, four) connecting pieces 4. A fluid or fuel conveying element such as for example a fuel line may be attached to the connecting pieces 4 or to the outwardly emerging through opening 5 in order to distribute and convey the fluid delivered by the rail accordingly to the cylinders of an internal combustion engine.

The component 1 moreover has an attachment flange 6 for attaching the component 1. In the exemplary embodiment shown, the component 1 or the main body 2 has a total of four attachment flanges 6. However, the number of attachment flanges 6 is not limited. The attachment flanges 6 are in this case preferably arranged at two opposite sides of the main body 1 in relation to its longitudinal axis L2 and distributed in its longitudinal direction, the distribution and the arrangement not being restricted by the invention. Instead, it is preferably to provide the most weight-optimized and attachment-optimized arrangement of the attachment flange 6.

As can be seen especially in FIG. 1, at least some of the attachment flanges 6 may be formed integrally with some of the connection flanges 4. In the exemplary embodiment shown, this applies to the connection flanges 4 and attachment flanges 6 each situated on the outside (here, left and right) looking in the longitudinal direction of the main body 2.

In one preferred embodiment, the main body 2 as well as the attachment flange 6 and, if present, also the connection flange 4 are formed integrally with each other. In one preferred embodiment, the integrated component consisting of main body 2, attachment flange 6 and optionally connection flange 4 are made by forging, although other kinds of production (such as casting) are also conceivable.

The attachment flange 6 has a through borehole 7 extending longitudinally through the attachment flange 6. This is especially evident in FIG. 2. The through borehole 7 has two openings 70, 71 opposite each other in terms of the longitudinal axis L7 of the through borehole 7.

Furthermore, the component 1 moreover has a pin 80 (with longitudinal borehole 81) or attachment sleeve 8 inserted into the through borehole 7. The attachment sleeve 8 on the side of one of the openings 70, 71—the upper opening 70 in FIG. 2—is arranged flush with the attachment flange 6 and extends from this one opening 70 through the through borehole 7 and through the other opening 71 in order to project from the attachment flange 6, as is shown in particular in FIGS. 6 and 7. Owing to the projecting of the attachment sleeve 8, the component 1 can be mounted in a defined position on an associated component—such as for example an engine block.

Figure 4:
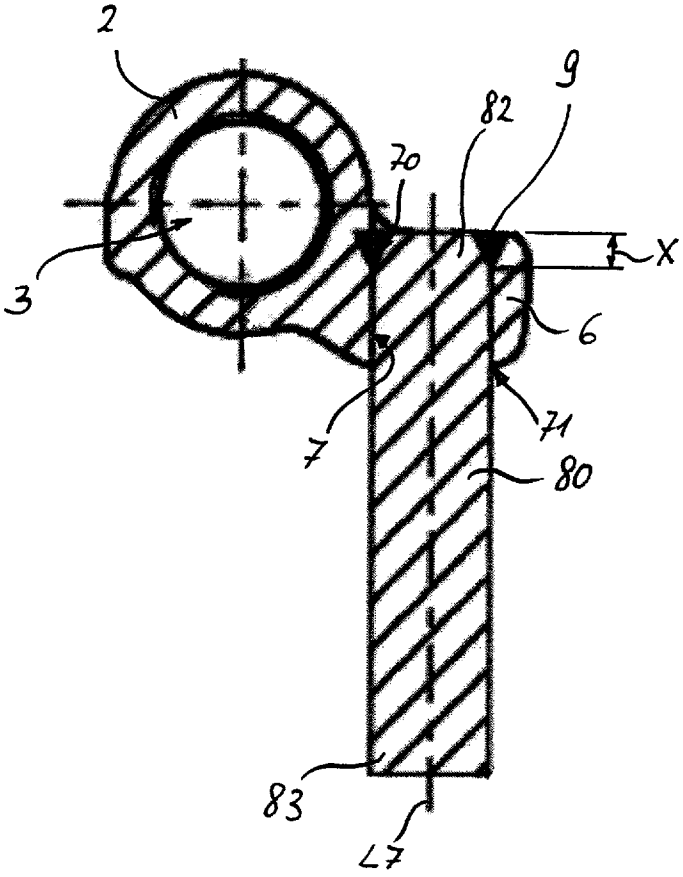

As shown in detail in FIG. 4, the attachment sleeve 8—represented here again as a pin 80 without longitudinal borehole 81—can be materially bonded to the attachment flange 6.

Since the attachment sleeve 8 for easy introducing into the through borehole 7 is preferably only inserted substantially loosely (e.g., with a clearance fit) or with a transition fit into the through borehole 7, the additional materially bonded connection 9 provides a sufficiently strong and secure connection of the two components, main body 2 or attachment flange 6 on the one hand and attachment sleeve 8 on the other hand.

As is likewise seen in FIG. 4, the attachment sleeve 8 can be materially bonded all around to the attachment flange 6 at least in the region of the one opening 70—here, the upper opening—and preferably closing the one opening 70. For example, an appropriate welded connection 9 can make possible an especially secure connection of the two components 2, 6, 8, strong enough to meet the requirements. The materially bonded connection 9 is formed especially by welding and preferably by laser welding. The materially bonded connection 9, especially a weld seam 9 formed by the welding, is preferably formed overlapping the attachment flange 6 and the attachment sleeve 8, as can be seen in FIG. 4. The materially bonded connection 9 and especially a weld seam 9 formed by the welding may have a depth X of 2 to 10 mm, preferably 3 to 7 mm and especially preferably 3.5 to 6 mm, these dimensions not being limited by the invention, and in particular depending on the geometry and dimension and also the materials employed for the components used.

As can be seen in FIG. 4, deeper welding spots are thus also permissible on the surface, in the region of the weld seam 9, which consequently result in an especially stable connection of the components of the attachment sleeve 8 on the one hand and the attachment flange 6 on the other.

In one preferred embodiment, the through borehole 7 may widen from the one opening 70 to the other opening 71, so as to thus form an inserting slope for the attachment sleeve 8 or the pin 80. The through borehole 7 preferably has a conical shape overall or at least partly—preferably on the side of the one opening 70. The attachment sleeve 8 or a corresponding pin 80 is introduced for this purpose from the side of the other opening 71 in the direction of the one opening 70 into the through borehole 7, until the correspondingly introduced end 82 of attachment sleeve 8 or pin 80 is arranged appropriately flush (here, flush at the top) with the attachment flange 9, so that they can then be materially bonded together. This geometrical configuration of the through borehole 7 thus also enables a simplified automatic feeding of a corresponding attachment sleeve 8 or pin 80 into the through borehole 7. In one preferred embodiment, the end 82 being introduced or introduced may have a shape corresponding to the through borehole 7—at least in its widened region; thus, e.g., it may likewise be conical in shape.

In one preferred embodiment, the attachment sleeve 8 lies against the inner wall 72 of the through borehole 7 at least in the area of the one opening 70—i.e., the opening 70 at which the materially bonded connection 9 is preferably provided. This ensures that the attachment sleeve 8 (or pin 80) on the one hand and the attachment flange 6 on the other hand are brought sufficiently close to each other—for example in the form of a clearance or transition fit—especially in the region of the butt weld—i.e., in the area of the one opening 70—so as to form a sufficiently secure materially bonded connection 9.

In one preferred embodiment, attachment sleeve 8 or pin 80—especially their end 82 introduced into the through borehole 7—and the through borehole 7 have the same cross sectional contour and especially a corresponding shape. The cross sectional contour is preferably round and the shape is preferably cylindrical or conical, although the invention is not confined to such configurations.

Figure 5:
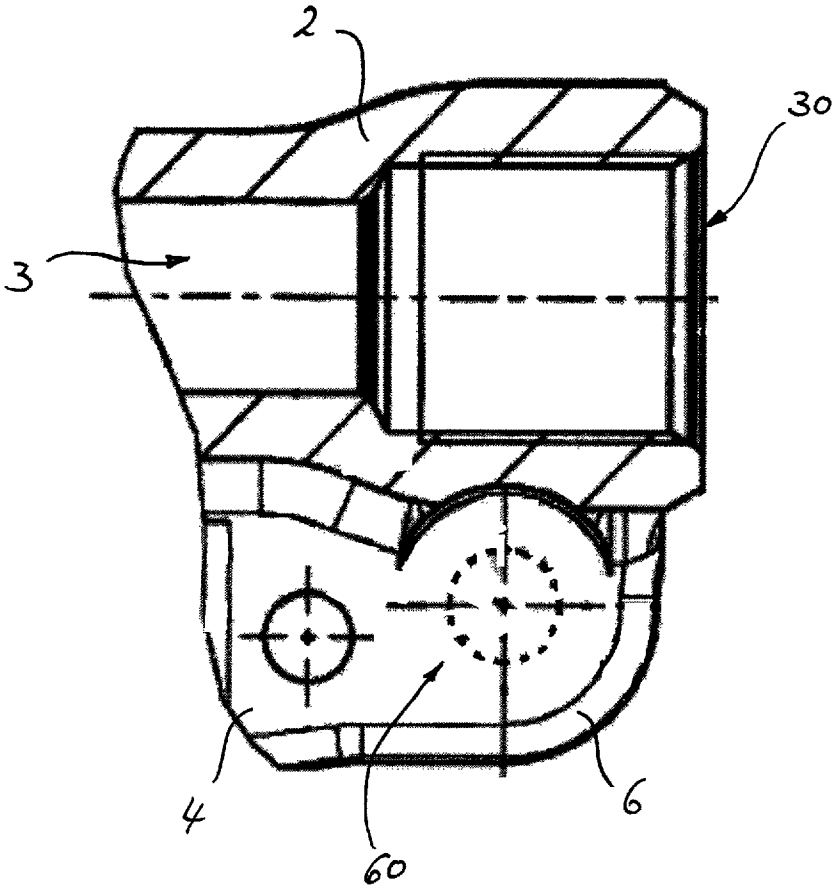
Figure 6:
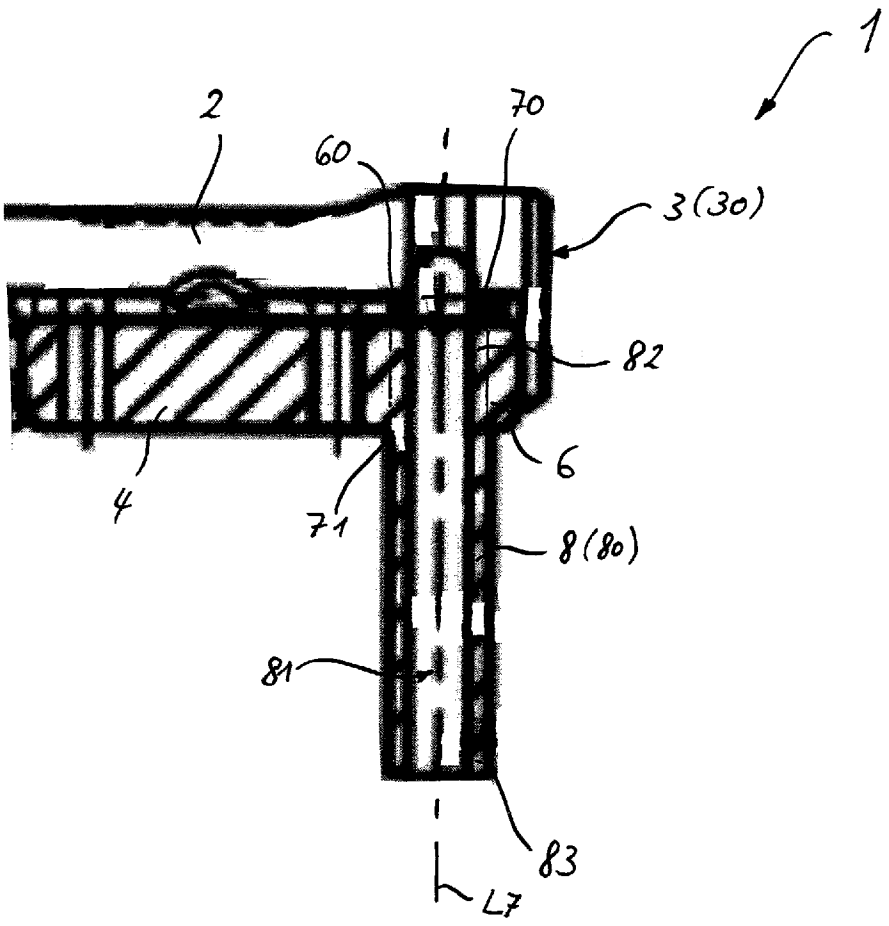

As is seen especially in FIGS. 5 to 7, the attachment flange 6 has, on the side of the one opening 70, a bearing surface 60 for a flange region, especially a screw head, of an attachment element extending through the attachment sleeve 8, especially an attachment screw, for the mounting of the internally pressurized component 1. In this way, a secure placement and thus a defined attachment of the component 1 to a corresponding installation region can be provided.

In the following, a method according to the invention shall be described for the production of an internally pressurized component 1 according to the present invention.

Figure 3:
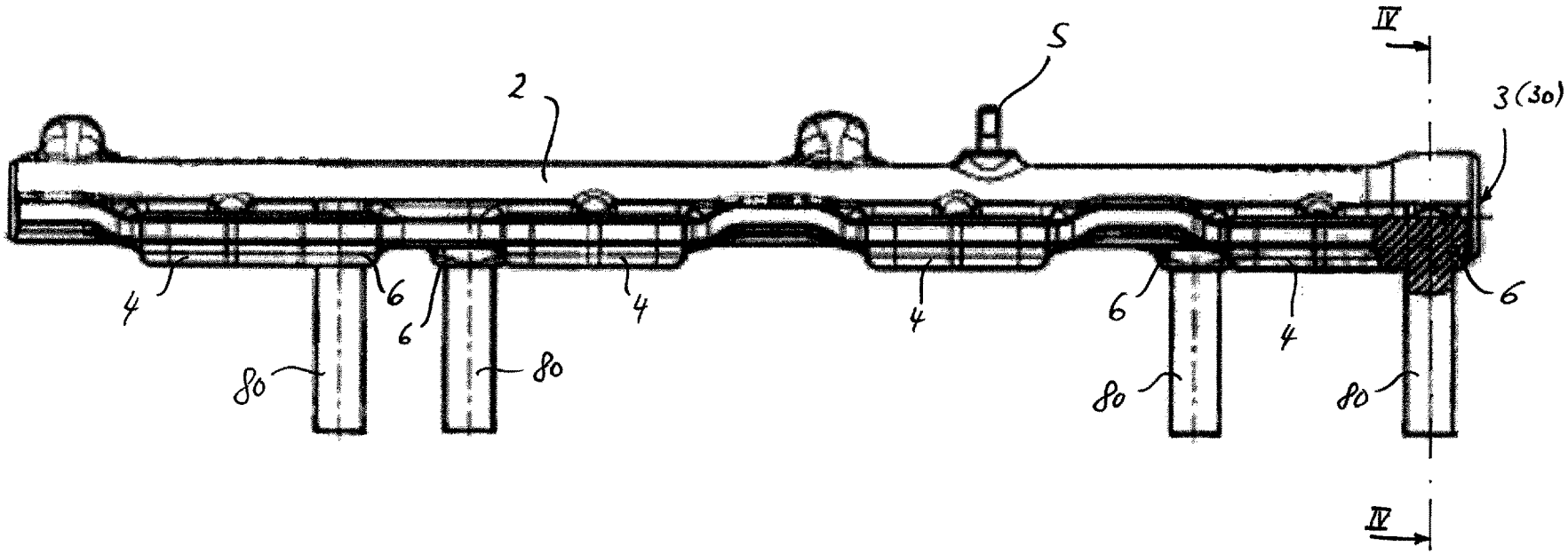

In a first step, a main body 2 with a longitudinal cavity 3 and with an attachment flange 6 for the attachment of the internally pressurized component 1 is at first provided. Such a main body 2 is shown, for example, in FIG. 1. Furthermore, a pin 80 as is shown for example in FIGS. 3 and 4 is provided. The pin 80 may be provided in this or a later method step with a longitudinal borehole 81 in order to form an attachment sleeve 8.

Moreover, at least one connection flange 4 may be provided on the main body 2. This connection flange 4 preferably has an outwardly open through opening 5 emerging into the longitudinal cavity 3.

Figure 2:
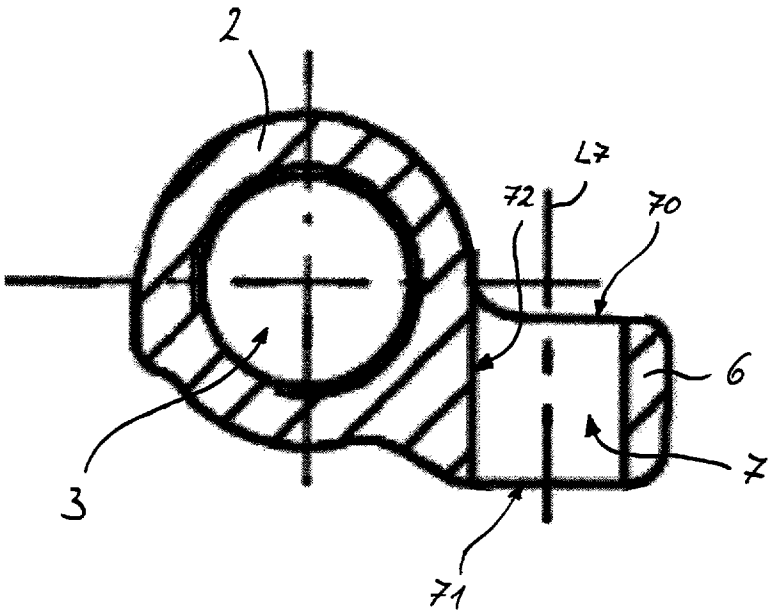

In a further step, a through borehole 7 that extends longitudinally through the attachment flange 6 is introduced into the attachment flange 6, such that it has two opposite openings 70, 71 with respect to the longitudinal axis L7 of the attachment flange 6. This is shown in FIG. 2. Both the through borehole 7 and the longitudinal borehole 81, and also the longitudinal cavity 3 and the through opening 5, can be introduced by means of cutting production methods, such as drilling, milling, reaming and/or honing.

Furthermore, the main body 2, preferably together with the attachment flange 6 and/or the connection flange 4, can be integrally formed and produced for example by forging.

In a further step, the pin 80 is inserted into the through borehole 7 such that the pin 80 is arranged flush with the attachment flange 6 on the side of one of the openings, here the upper opening 70, and extends from this opening 70 through the through borehole 7 and the other opening 71 in order to project from the attachment flange 6. This is shown especially in FIG. 3. In particular, given a widening (e.g., conical) configuration of the through borehole 7 from the one opening 70 to the other opening 71—and possibly in corresponding shape of the end 82 to be inserted—an easy introducing of the pin 70 into the through borehole 7 can be made possible when introducing the pin 80 via the widened region—here, the opening 71—into the through borehole 7. This, in turn, also makes possible an easy automatic feeding of the pin 80 into the through borehole 7.

The pin 80 is inserted into the borehole 7 such that it is inserted substantially loosely (preferably with a clearance fit) or also with a transition fit into the through borehole 7. Depending on the configuration of the through borehole 7 (and possibly the corresponding configuration of the introduced end 82), the pin 80 may lie preferably all around against the inner wall 72 of the through borehole 7 at least in the area of the one opening 70. In this way, it can be ensured that a pin 80, once introduced, cannot easily fall out—i.e. for example, by gravity—until a later connection step to the attachment flange 6. However, the quite "loose" connection between pin 80 on the one hand and attachment flange 6 on the other hand can make possible an especially easy inserting of the pin 80.

In a further step, the pin is materially bonded to the attachment flange 6. The materially bonded connection 9 is provided all around, preferably at least in the region of the one opening 70 and preferably closing the opening 70. The step of the material bonding is carried out preferably by means of welding and especially by means of laser welding. Owing to the performance of such a welding step preferably at one end (here, from above), an especially simple and at the same time secure providing of such a connection is made possible. This can be seen, for example, in FIG. 4.

Optionally, after the materially bonded connection 9, regions of such a resultant weld seam 9 projecting from the attachment flange 6 can be removed in a following step. In particular, these regions may be removed by milling or grinding, for example, in order to thus also form a flat bearing surface 60—as described above. This step is shown for example in FIG. 5.

The further step of introducing a longitudinal borehole 81 into the pin 8 in order to form an attachment sleeve 8 can preferably also be carried out after the step of the materially bonded connection 9. It is also conceivable to perform the introducing of the longitudinal borehole 81—as well as every other step for the providing of a borehole 3, 81, 7, 5—in several steps in immediate succession or also separated by other method steps. For example, at first a corresponding borehole 7, 81, 3, 5 can be introduced and then finished in subsequent fine machining steps.

Basically, therefore, it is also conceivable to provide the solid pin 80 at once when providing with a longitudinal borehole 81 in order to be provided as corresponding attachment sleeve 8. Then, by means of this attachment sleeve 8, the previously described steps are performed—i.e., the inserting of the attachment sleeve 80 appropriately into the through borehole 7 and the material bonding of the attachment sleeve 8 to the attachment flange 6.

In a further step, the pin 80 or the attachment sleeve 8 may be cut to length at its end 83 opposite the attachment flange 6 and preferably milled flat in order to reduce attachment sleeve 8 or pin 80 finally to a desired length and provide it with a corresponding orientation or contour, corresponding to the respective installation region, in order to make possible a secure mounting via the attachment sleeves 8 in an engine block, for example.

The method as described above can be at least partly automated or carried out partly automatically.

In particular, the present invention also comprises an internally pressurized component 1 which has been produced by a method according to the present invention.

The present invention is not confined to the above described exemplary embodiment insofar as is encompassed by the subject matter of the following claims. In particular, the present invention is not confined either to corresponding materials or dimensions, or to geometrical configurations of the individual components. Neither is the number of attachment flanges 6, connection flanges 4 and attachment sleeves 8 for example limited by the invention.

We claim:

1. A method for the production of an internally pressurized component (1), said method comprises the following steps:

providing a main body (2) with a longitudinal cavity (3) and with an attachment flange (6) for attachment of the internally pressurized component (1), providing a pin (80), introducing a through borehole (7) that extends longitudinally through the attachment flange (6) and having two opposite openings (70, 71) with respect to the longitudinal axis (L7), inserting the pin (80) into the through borehole (7) such that the pin (80) is arranged flush with the attachment flange (6) on the side of one of the openings (70) and extends from this opening (70) through the through borehole (7) and through the other opening (71) in order to project from the attachment flange (6), materially bonding the pin (80) to the attachment flange (6), and introducing a longitudinal borehole (81) into the pin (80) to form an attachment sleeve (8) a wherein the pin (80) or the attachment sleeve (8) is inserted with a clearance fit or with a transition fit into the through borehole (7).

2. The method as claimed in claim 1, wherein the introduced pin (80) or the introduced attachment sleeve (8) lies all around against the inner wall (72) of the through borehole (7), at least in the region of the one opening (70).

3. The method as claimed in claim 1, wherein the materially bonded connection (9) is provided at least in the region of the one opening (70).

4. The method as claimed in claim 3, wherein the materially bonded connection (9) is provided all around the one opening (70).

5. The method as claimed in claim 1, wherein the step of the material bonding is done by welding.

6. The method as claimed in claim 1, wherein, after the material bonding, regions of such a resultant weld seam (9) projecting from the attachment flange (6) are removed.

7. The method as claimed in claim 1, wherein at least one connection flange (4) is provided on the main body (2) with a through opening (5) which is open to the outside and emerges into the longitudinal cavity (3).

8. The method as claimed in claim 1, wherein the main body (2) is formed integrally.

9. The method as claimed in claim 8, wherein the main body (2) is produced by forging.

10. The method as claimed in claim 1, wherein the through borehole (7) and/or the longitudinal borehole (81) and/or the longitudinal cavity (3) and/or the through opening (5) are introduced by cutting production methods.

11. The method as claimed in claim 1, wherein the pin (80) or the attachment sleeve (8) is cut to length at its end (83) opposite the attachment flange (6).

12. The method as claimed in claim 1, wherein the method is at least partly automated or performed partly automatically.

13. An internally pressurized component (1) made by a method as claimed in claim 1.

14. An internally pressurized component (1) comprising a main body (2) with a longitudinal cavity (3), an attachment flange (6) for attachment of the internally pressurized component (1), the attachment flange (6) having a through borehole (7) that extends longitudinally through the attachment flange (6) and having two opposite openings (70, 71) with respect to the longitudinal axis (L7), and an attachment sleeve (8) inserted into the through borehole (7), wherein the attachment sleeve (8) is arranged flush with the attachment flange (6) on the side of one of the openings (70) and extends from this opening (70) through the through borehole (7) and through the other opening (71) in order to project from the attachment flange (6), wherein the attachment sleeve (8) is materially bonded to the attachment flange (6) wherein the attachment sleeve (6) is inserted with a clearance fit or with a transition fit into the through borehole (7).

15. The internally pressurized component (1) as claimed in claim 14, wherein the attachment sleeve (8) is materially bonded to the attachment flange (6) at least in the region of the one opening (70).

16. The internally pressurized component (1) as claimed in claim 15, wherein the attachment sleeve (8) is materially bonded to the attachment flange (6) all around the one opening (70).

17. The internally pressurized component (1) as claimed in claim 14, wherein the materially bonded connection (9) is produced by welding.

18. The internally pressurized component (1) as claimed in claim 14, wherein the materially bonded connection (9) is formed overlapping the attachment flange (6) and the attachment sleeve (8).

19. The internally pressurized component (1) as claimed in claim 14, wherein the main body (2) and the attachment flange (6) are formed integrally with each other.

20. The internally pressurized component (1) as claimed in claim 19, wherein the main body (2) and the attachment flange (6) are forged as an integral component.

21. The internally pressurized component (1) as claimed in claim 14, wherein the materially bonded connection (9) has a depth of 2 to 10 mm, or 3 to 7 mm, or 3.5 to 6 mm.

22. The internally pressurized component (1) as claimed in claim 14, wherein the through borehole (7) widens from the one opening (70) to the other opening (71 in order to form an inserting slope for the attachment sleeve (8).

23. The internally pressurized component (1) as claimed in claim 14, wherein the attachment sleeve (8) lies all around against the inner wall (72) of the through borehole (7).

24. The internally pressurized component (1) as claimed in claim 14, wherein the attachment sleeve (8) and the through borehole (7) have the same cross section contour or a corresponding shape.

25. The internally pressurized component (1) as claimed in claim 14, moreover comprising at least one connection flange (4) with a through opening (5) which is open to the outside and emerges into the longitudinal cavity (3).

26. The internally pressurized component (1) as claimed in claim 14 being a high-pressure fuel storage (rail).

27. The internally pressurized component (1) as claimed in claim 14, wherein the attachment flange (6) has a bearing surface (60) for a flange region of an attachment element extending through the attachment sleeve (8) on the side of the one opening (70) for the mounting of the internally pressurized component (1).

28. The method as claimed in claim 1, wherein the internally pressurized component (1) is in the formation of a high-pressure fuel storage (rail).

* * * * *